US005162615A

United States Patent [19]

Schrader et al.

[11] Patent Number: 5,162,615

[45] Date of Patent: Nov. 10, 1992

[54] FULL CLOSURE H-SHAPED CONNECTOR

[75] Inventors: Gary E. Schrader, Manchester; Urs F. Nager, Hudson, both of N.H.

[73] Assignee: Burndy Corporation, Norwalk, Conn.

[21] Appl. No.: 842,770

[22] Filed: Mar. 2, 1992

Related U.S. Application Data

[63] Continuation of Ser. No. 655,991, Feb. 15, 1991, abandoned.

[51] Int. Cl.[5] ..... H01R 4/18; H01R 43/04

[52] U.S. Cl. ..... 174/94 R; 29/872; 29/863; 174/71 R; 174/84 C; 403/275; 403/391; 439/877

[58] Field of Search ..... 174/94 R, 71 R, 84 R, 174/84 C; 403/391, 275; 439/877; 29/861, 863, 872

[56] References Cited

U.S. PATENT DOCUMENTS

| | | | |
|---|---|---|---|
| 2,307,216 | 1/1943 | Graham | 174/84 C |
| 3,022,370 | 2/1962 | Osborn | 174/71 R |
| 3,088,993 | 5/1963 | Matthysse et al. | 174/71 R |
| 3,235,654 | 2/1966 | Eldridge, Jr. | 174/94 R |
| 3,354,517 | 11/1967 | Levinsky | 403/275 |
| 3,746,777 | 7/1973 | Peek | 174/94 R |
| 3,781,459 | 12/1973 | Peek | 174/94 R |
| 5,103,068 | 4/1992 | Schrader | 174/94 R |

FOREIGN PATENT DOCUMENTS

| | | |
|---|---|---|
| 2011859 | 10/1979 | Fed. Rep. of Germany . |
| 2319216 | 2/1977 | France . |

*Primary Examiner*—Morris H. Nimmo

*Attorney, Agent, or Firm*—Mitchell B. Wasson; Martin P. Hoffman; Burtsell J. Kearns

[57] ABSTRACT

An H-shaped compressible connector having a main body and two pairs of opposed legs extending in opposite directions from the main body. Each pair of opposed legs is provided with one leg which is curved inwardly with respect to the second leg. During the crimping process, this curved leg would move below the interior surface of the second leg in each pair, thereby providing a completely closed connector for various conductor sizes.

12 Claims, 1 Drawing Sheet

FULL CLOSURE H-SHAPED CONNECTOR

This is a continuation of copending application Ser. No. 07/655,991 filed on Feb. 15, 1991, abandoned.

BACKGROUND OF THE INVENTION

The field of this invention broadly pertains to electrical connectors for wires or cable conductors. More specifically, the invention relates to a compression-type electrical connector for connecting a first conductor to a second conductor in an electrical power distribution system. For example, the present invention could be utilized in establishing a tap connection to provide a branch current from a continuous run power cable. An electrical connector of the aforesaid type is typically adapted to receive a tap conductor, to engage a continuous run conductor, and to be compressed by means of a crimping tool to achieve the desired connection.

Due to the fact that the various wires or conductors which would be connected in a connector are of varying diameters, it is important that a connector be developed which would be fully closed, after the crimping operation, around these variously sized wires and conductors.

U.S. Pat. Nos. 3,022,370 to Osborn; 3,088,993 to Mathysse et al and 3,235,654 to Eldridge, Jr. are typical of prior art compression connectors. All three of these patents describe compression connectors having slots or channels for receiving wires and conductors therein prior to the crimping process. Both the Osborn and Matthysse et al patents are provided with two slots or channels to receive wires and conductors therein. The configuration of each of these slots or channels is different to allow differently sized wires or conductors to be connected. Once these wires are provided within their respective slots or channels, the crimping process takes place.

The patent to Eldridge, Jr. shows a compression conductor having two slots or channels which could be equally dimensioned. One or more tabs have been provided to enclose the wire therein. Although it is true that this connector is adapted for use with a great range of wire sizes, thereby reducing the number of fitting sizes needed to accommodate a given range of wire sizes, the fact that a tab must be utilized makes this connector more expensive and difficult to manufacture.

BACKGROUND OF THE INVENTION

The field of this invention broadly pertains to electrical connectors for wires or cable conductors. More specifically, the invention relates to a compression-type electrical connector for connecting a first conductor to a second conductor in an electrical power distribution system. For example, the present invention could be utilized in establishing a tap connection to provide a branch current from a continuous run power cable. An electrical connector of the aforesaid type is typically adapted to receive a tap conductor, to engage a continuous run conductor, and to be compressed by means of a crimping tool to achieve the desired connection.

Due to the fact that the various wires or conductors which would be connected in a connector are of varying diameters, it is important that a connector be developed which would be fully closed, after the crimping operation, around these variously sized wires and conductors.

U.S. Pat. Nos. 3,022,370 to Osborn; 3,088,993 to Mathysse et al and 3,235,654 to Eldridge, Jr. are typical of prior art compression connectors. All three of these patents describe compression connectors having slots or channels for receiving wires and conductors therein prior to the crimping process. Both the Osborn and Matthysse et al patents are provided with two slots or channels to receive wires and conductors therein. The configuration of each of these slots or channels is different to allow differently sized wires or conductors to be connected. Once these wires are provided within their respective slots or channels, the crimping process takes place.

The patent to Eldridge, Jr. shows a compression conductor having two slots or channels which could be equally dimensioned. One or more tabs have been provided to enclose the wire therein. Although it is true that this connector is adapted for use with a great range of wire sizes, thereby reducing the number of fitting sizes needed to accommodate a given range of wire sizes, the fact that a tab must be utilized makes this connector more expensive and difficult to manufacture.

The prior art references describe compression connectors whereby human involvement is needed to fold the connector closures in place, prior to inserting the connector in the crimping device.

SUMMARY OF THE INVENTION

The present invention overcomes the deficiencies of the prior art by providing an H-shaped connector adapted to be used with a great range of wire or conductor sizes. Each pair of legs in the H-shaped connector is provided with either an elongated portion at its distal end or a curved portion at its distal end. Since each of the legs is approximately the same length, each leg having an elongated portion at its distal end would, of course, extend for a further distance from the main portion of the connector body than would its opposed leg, having a curved portion at its distal end. Based upon this configuration, when the H-shaped connector is placed within a crimping tool, and the compression is complete, the curved portion of each leg would extend under the elongated portion of its opposed leg, thereby producing a connector which is fully closed around a range of wires or conductors.

One of the purposes of the present design is to greatly extend the wire range over the prior art for a given groove diameter by taking advantage of the self-coiling action which occurs when the legs at each end slide over each opposed leg, thereby increasing the collapsibility of the connector to accommodate not only rigid conductors, but also extremely flexible conductors.

BRIEF DESCRIPTION OF THE DRAWINGS

The foregoing and other objects and advantages of the present invention will be better understood with reference to the following detailed description of a preferred embodiment thereof., which is illustrated, by way of example, in the accompanying drawings, wherein.

DETAILED DESCRIPTION OF THE INVENTION

Figure 1:
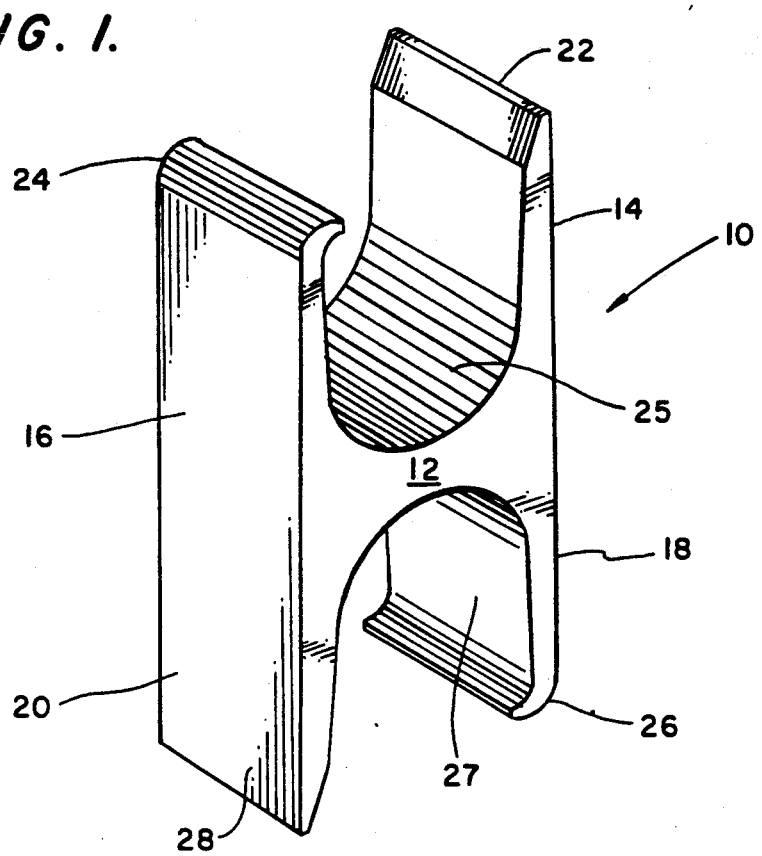
FIG. 1 is a perspective view of the present invention.

FIG. 1 illustrates the compression connector 10 of the present invention which is configured in an H-shape. This connector is provided with a main body portion 12 with opposed legs 14 and 16 extending in one direction, and parallel with one another, from the main body 12. A second pair of opposed legs 18, 20 extends in a second direction from the main body 12 and are substantially parallel with one another. Leg 14 has an elongated distal end 22 and leg 16 is provided with a curved distal end 24, curving toward leg 14. Leg 18 contains a curved distal end 26 and leg 20 is provided with an elongated distal end 28. The curved portion 26 of leg 18 curves toward leg 20. The area between the legs 14 and 16 produces a transversely facing recess 25. Similarly, the area between legs 18 and 20 also produces a transversely facing recess 27. As illustrated in FIG. 1, the length of each of the pairs of legs 14, 16 and 18, 20 is substantially equal. However, due to the curved portions 24 in leg 16 and 26 in leg 18, each of the distal portions 22 and 28 of legs 14 and 20, respectively, would extend beyond the curved portions 24 and 26. However, it is noted that the length of legs 14 and 16 need not be equal to the length of legs 18 and 20 to provide for differently sized wires or conductors. Differently sized wires and conductors are adapted to be provided within each of the recesses 25, 27, as shown in FIG. 3.

Figure 2:
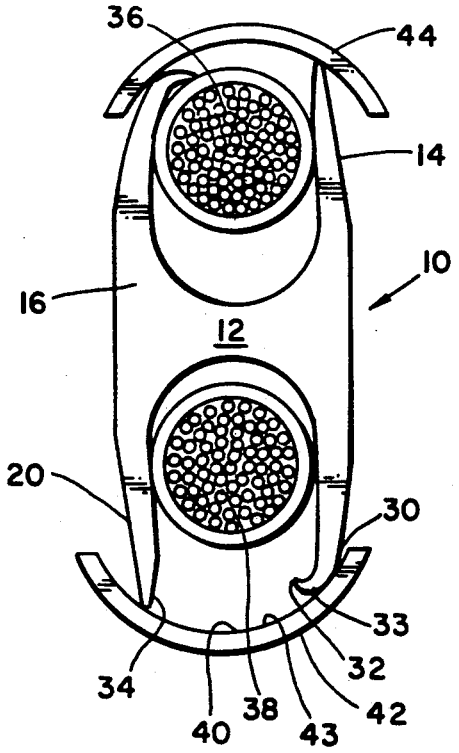
FIG. 2 is a side elevational view of the present invention within a crimping tool.

FIG. 2 illustrates the connector of the present invention when it is provided between die surfaces 42, 44. These die surfaces can be provided in any suitable crimping device, such as a mechanically activated, hydraulically activated or pneumatically activated crimping device, or any other mechanism which would effectively crimp the connector around the conductors.

As the compressive force of the crimping mechanism is initiated, points 30 and 34 will yield and follow the contour of the die surface 43. Point 32 will remain above and free from the surface of the die 43. When legs 18, 20 of connector 10 reach the vertex 40 of the die, points 34 and 33 will contact each other. As the compression continues, a distinct positional decision will be made with leg 20 moving around the outer surface of leg 18. Both legs will continue to fold and slide around each other until compression is complete. A similar occurrence would result in leg 14 moving around the outer surface of leg 16.

Figure 3:
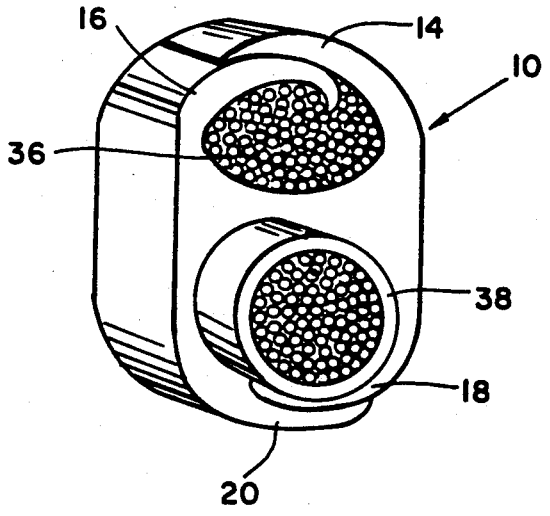
FIG. 3 is a perspective drawing of the present invention after it has been crimped.

FIG. 3 depicts the conductor 10 after the crimping process has been completed. As shown therein, cables 36 and 38 would be fully enclosed when the compression process is completed. As shown, leg 14 would be provided above leg 16 and leg 20 would be provided above leg 28.

Connector 10 can be made from virtually any metallic material from which standard compression connectors are made and can be produced in a single step extrusion process. For example, connector 10 can be made from a tin-plated copper or an aluminum based material.

While the preferred embodiment of the present invention has been shown and described herein, it is obvious that many structural details may be changed without departing from the spirit and scope of the appended claims.

What is claimed is:

1. A compression connector capable of being deformed in a crimping device, comprising a body of compressive material formed in generally an H shape; said connector provided with a central body portion and first and second pairs of opposed parallel legs extending from said central body portion, each leg of said first pair of legs substantially equal in length to each other, and each leg of said second pairs of legs substantially equal in length to each other, said first and second pairs of legs extending in opposite directions from said central body portion to form first and second channels therebetween, the distal portion of one leg of each of said first and second parallel legs being provided with a portion curved inwardly toward each of said respective first and second channels, wherein when conductors are provided in said first and second channels transverse to the connector and said connector is inserted in a crimping device the direct application of pressure by the crimping device to each leg of said first and second pairs of legs would force each of said legs provided with said curved portion under its respective opposed leg to completely close the connector around the conductors provided in said first and second channels.

2. The compression connector in accordance with claim 1, wherein all of said legs are substantially equal in length.

3. The compression connector in accordance with claim 1, wherein said legs provided with curved portions are disposed diagonally with respect to one another.

4. The compression connector in accordance with claim 1, wherein said first and second channels are formed to receive conductors of varying cross-sectional dimensions.

5. A compression connector capable of being deformed in a crimping device, comprising a body of compressive material formed in generally an H shape, said connector provided with a parallel legs extending from said central body portion, each leg of said first pair of legs substantially equal in length to each other, and each leg of said second pair of legs substantially equal in length to each other, said first and second pairs of legs extending in opposite directions from said central body portion to form first and second channels therebetween, the distal portion of at least one leg of either of said first or second pair of parallel legs being provided with a portion curved inwardly toward its respective adjacent said first or second channel wherein a conductor is provided in said adjacent channel transverse to the connector and said connector inserted in a crimping device, the application of pressure by the crimping device would force said leg provided with said curved portion under its respective opposed leg to completely close the connector around the conductor provided in said adjacent channel.

6. The compression connector in accordance with claim 5, wherein all of said legs are substantially equal in length.

7. The compression connector of claim 6, wherein at least one leg of each of said first or second pair of parallel legs is provided with an inwardly curved portion.

8. The compression connector in accordance with claim 7, wherein said legs provided with curved portions are disposed diagonally with respect to one another.

9. A compression connector capable of being deformed in a crimping device, comprising a body of compressive material formed in generally an H shape, said connector provided with a central body portion and first and second pairs of opposed parallel legs extending from said central body portion, said first and second pairs of legs extending in opposite directions from said central body portion to form first and second channels therebetween, the distal portion of one leg of each of said first and second parallel legs being provided with a portion curved inwardly toward each of said respective first and second channels, wherein when conductors are provided in said first and second channels tranverse to the connector and said connector is inserted in a crimping device the direct application of pressure by the crimping device to the tip of each leg of said first and second pairs of legs would force each of said legs provided with said curved portion under its respective opposed leg to completely close the connector around the conductors provided in said first and second channels.

10. The compression connector in accordance with claim 9, wherein each of said legs is substantially equal in length.

11. The compression connector in accordance with claim 9, wherein said legs provided with curved portions are disposed diagonally with respect to one another.

12. A method of compressing a compressible connector including the steps of:

producing an uncompressed compressible connector of compressible material, formed in generally an H shape with a central body portion and first and second pairs of opposed parallel legs extending from said central body portion, each leg of said first pair of legs substantially equal in length to each other, and each leg of said second pair of legs substantially equal in length to each other, said first and second pairs of legs extending in opposite directions from said central body portion to form first and second channels therebetween, the distal portion of one leg of each of said first and second parallel legs being provided with a portion curved inwardly toward each of said respective first and second channels;

inserting conductors in each of said first and second channels;

placing said connector in a crimping device having top and bottom curved die surfaces, the top portion of each of the legs initially in contact with one of said die surfaces;

applying pressure to said crimping device to force said top and bottom die surfaces together, said pressure forcing each of said legs provided with said curved portion under its respective opposed leg to completely close the connector around the conducts provided in said first and second channels.

* * * * *

US005162615A

REEXAMINATION CERTIFICATE (2346th)

United States Patent [19]

Schrader et al.

[11] B1 5,162,615

[45] Certificate Issued Jul. 26, 1994

[54] FULL CLOSURE H-SHAPED CONNECTOR

[75] Inventors: Gary E. Schrader, Manchester; Urs F. Nager, Hudson, both of N.H.

[73] Assignee: Burndy Corporation, Norwalk, Conn.

Reexamination Request:
No. 90/003,096, Jun. 16, 1993

Reexamination Certificate for:

| | |
|---|---|
| Patent No.: | **5,162,615** |
| Issued: | **Nov. 10, 1992** |
| Appl. No.: | **842,770** |
| Filed: | **Mar. 2, 1992** |

Related U.S. Application Data

[63] Continuation of Ser. No. 665,991, Feb. 15, 1991, abandoned.

[51] Int. Cl.[5] ..... H01R 4/18; H01R 43/04

[52] U.S. Cl. ..... 174/94 R; 29/872; 29/863; 174/71 R; 174/84 C; 403/275; 403/391; 439/877

[58] Field of Search ..... 174/94 R, 71 R, 84 R, 174/84 C; 403/391, 275; 439/877; 29/861, 863, 872

[56] References Cited

U.S. PATENT DOCUMENTS

| | | | |
|---|---|---|---|
| 2,307,216 | 1/1943 | Graham | 174/84 C |
| 3,022,370 | 2/1962 | Osborn | 174/71 R |
| 3,076,255 | 2/1963 | Woolley, Jr. | 29/155.55 |
| 3,088,993 | 5/1963 | Matthysse et al. | 174/71 R |
| 3,156,764 | 11/1964 | Toedtman | 174/94 |
| 3,235,654 | 2/1966 | Eldridge, Jr. | 174/94 R |
| 3,330,903 | 7/1967 | Holke et al. | 174/94 |
| 3,354,517 | 11/1967 | Levinsky | 403/275 |
| 3,746,777 | 7/1973 | Peek | 174/94 R |
| 3,781,459 | 12/1973 | Peek | 174/94 R |
| 5,103,068 | 4/1992 | Schrader | 174/94 R |

FOREIGN PATENT DOCUMENTS

| | | |
|---|---|---|
| 2011859 | 10/1979 | Fed. Rep. of Germany . |
| 2319216 | 2/1977 | France . |

*Primary Examiner*—Morris H. Nimmo

[57] ABSTRACT

An H-shaped compressible connector having a main body and two pairs of opposed legs extending in opposite directions from the main body. Each pair of opposed legs is provided with one leg which is curved inwardly with respect to the second leg. During the crimping process, this curved leg would move below the interior surface of the second leg in each pair, thereby providing a completely closed connector for various conductor sizes.

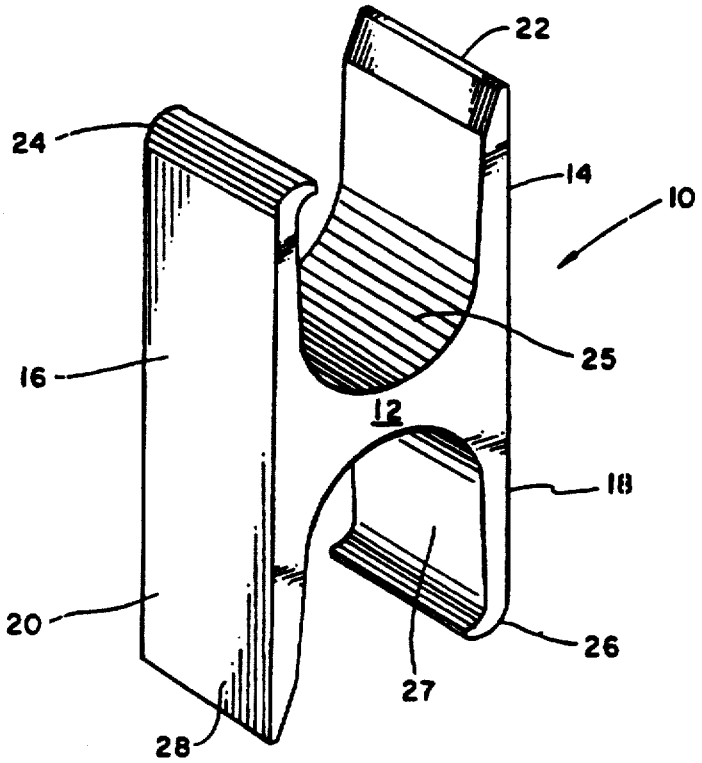

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 5, 9 and 12 are determined to be patentable as amended.

Claims 2–4, 6–8, 10 and 11, dependent on an amended claim, are determined to be patentable.

New claims 13 and 14 are added and determined to be patentable.

1. A compression connector capable of being deformed in a crimping device, comprising a body of compressive material formed in generally an H shape, said connector provided with a central body portion and first and second pairs of opposed parallel legs extending from said central body portion, each leg of said first pair of legs substantially equal in length to each other, and each leg of said second pair of legs substantially equal in length to each other, said first and second pairs of legs extending in opposite directions from said central body portion to form first and second channels therebetween, *each of said legs provided with an inner surface facing said first or second channel and an opposed outer surface, each of said outer surfaces being uniform and continuous for its entire length,* the distal portion of one leg of each of said first and second parallel legs being provided with a portion curved inwardly toward each of said respective first and second channels, wherein when conductors are provided in said first and second channels transverse to the connector and said connector is inserted in a crimping device the direct application of pressure by the crimping device to each leg of said first and second pairs of legs would force each of said legs provided with said curved portion under its respective opposed leg to completely close the connector around the conductors provided in said first and second channels.

5. A compression connector capable of being deformed in a crimping device, comprising a body of compressive material formed in generally an H shape, said connector provided with [a parallel legs] *a central body portion and first and second pairs of opposed parallel legs* extending from said central body portion, each leg of said first pair of legs substantially equal in length to each other, and each leg of said second pair of legs substantially equal in length to each other, said first and second pairs of legs extending in opposite directions from said central body portion to form first and second channels therebetween *each of said legs provided with an inner surface facing said first or second channel and an opposed outer surface, each of said outer surfaces being uniform and continuous for its entire length,* the distal portion of at least one leg of either of said first or second pair of parallel legs being provided with a portion curved inwardly toward its said respective adjacent said first or second channel wherein a conductor is provided in said adjacent channel transverse to the connector and said connector inserted in a crimping device, the application of pressure by the crimping device would force said leg provided with said curved portion under its respective opposed leg to completely close the connector around the conductor provided in said adjacent channel.

9. A compression connector capable of being deformed in a crimping device, comprising a body of compressive material formed in generally an H shape, said connector provided with a central body portion and first and second pairs of opposed parallel legs extending from said central body portion, said first and second pairs of legs extending in opposite directions from said central body portion to form first and second channels therebetween *each of said legs provided with an inner surface facing said first or second channel and an opposed outer surface, each of said outer surfaces being uniform and continuous for its entire length,* the distal portion of one leg of each of said first and second parallel legs being provided with a portion curved inwardly toward each of said respective first and second channels, wherein when conductors are provided in said first and second channels transverse to the connector and said connector is inserted in a crimping device the direct application of pressure by the crimping device to the tip of each leg of said first and second pairs of legs would force each of said legs provided with said curved portion under its respective opposed leg to completely close the connector around the conductors provided in said first and second channels.

12. A method of compressing a compressible connector including the steps of:

producing an uncompressed compressible connector of compressible material, formed in generally an H shape with a central body portion and first and second pairs of opposed parallel legs extending from said central body portion, each leg of said first pair of legs substantially equal in length to each other, and each leg of said second pair of legs substantially equal in length to each other, said first and second pairs of legs extending in opposite directions from said central body portion to form first and second channels therebetween *each of said legs provided with an inner surface facing said first or second channel and an opposed outer surface, each of said outer surfaces being uniform and continuous for its entire length,* the distal portion of one leg of each of said first and second parallel legs being provided with a portion curved inwardly toward each of said respective first and second channels;

inserting conductors in each of said first and second channels;

placing said connector in a crimping device having top and bottom curved die surfaces, the top portion of each of the legs initially in contact with one of said die surfaces;

applying pressure to said crimping device to force said top and bottom die surfaces together, said pressure forcing each of said legs provided with said curved portion under its respective opposed leg to completely close the connector around the conducts provided in said first and second channels.

*13. The compression connector in accordance with claim 1, wherein the distal portion of said one leg of each of said first and second parallel legs forms a retention surface which terminates at a distance from said central body portion less than the distance from the termination of the distal portion of said second parallel legs of each pair of legs to said central body portion.*

*14. The compression connector in accordance with claim 5, wherein the distal portion of said one leg of each of said first and second parallel legs forms a retention surface which terminates at a distance from said central body portion less than the distance from the termination of the distal portion of said second parallel leg of each pair of legs to said central body portion.*

* * * * *